US005161336A

United States Patent [19]

Ritt et al.

[11] Patent Number: 5,161,336

[45] Date of Patent: Nov. 10, 1992

[54] INTAKE VALVE DEPOSIT REMOVAL APPARATUS

[75] Inventors: Robert T. Ritt; David A. Kammeraad, both of Holland, Mich.

[73] Assignee: K-Line Industries, Inc., Holland, Mich.

[21] Appl. No.: 711,660

[22] Filed: Jun. 6, 1991

[51] Int. Cl.[5] ..... B24C 3/04

[52] U.S. Cl. ..... 51/411; 51/319; 51/424; 51/427; 51/436; 51/439

[58] Field of Search ..... 51/317-321, 51/410, 411, 424, 425, 427, 436, 439

[56] References Cited

U.S. PATENT DOCUMENTS

| | | | |
|---|---|---|---|
| 3,477,178 | 11/1969 | Hulbert | 51/411 |
| 3,557,498 | 1/1971 | Lindsay | 51/427 |
| 3,791,078 | 2/1974 | Fleisher | 51/410 X |
| 3,869,830 | 3/1975 | Baker | 51/411 |
| 4,232,487 | 11/1980 | Brown | 51/425 |

OTHER PUBLICATIONS

"Carbon Blaster II", product brochure published by Kent-Moore, a Division of SPX Corporation, 29784 Little Mack, Roseville, Mi. 48066-2298, telephone 1-800-345-2233, date of publication unknown.

"Carbon Blaster", product brochure published by Kent-Moore, a Division of SPX Corporation, 29784 Little Mack, Roseville, Mi. 48066-2298, telephone 1-800-34-5-2233, date of publication unknown.

"Carbon Cleaner Kit", product brochure published by OTC Tool & Equipment, Division of SPX Corporation, date of publication unknown.

*Primary Examiner*—James G. Smith

*Attorney, Agent, or Firm*—Price, Heneveld, Cooper, DeWitt & Litton

[57] ABSTRACT

An apparatus is provided to remove undesirable deposits on an intake valve after only partial disassembly of an engine, the apparatus including a blasting device and suction device. The blasting device directs blast media against the undesirable buildup to clean the intake valve, and includes a remote control and specially constructed pressure tank that cooperates with the remote control to improve operation, convenience and safety during use. The suction device suctions away spent blast media and dislodged deposits and includes a universal adapter to permit the device to sealingly engage an exposed air intake opening on the partially disassembled engine. The suction device also includes spreadable grippers that engage the sides of a passageway to hold the suction device in place, and further includes an arrangement for generating a vacuum by use of compressed air.

49 Claims, 9 Drawing Sheets

INTAKE VALVE DEPOSIT REMOVAL APPARATUS

BACKGROUND OF THE INVENTION

The present invention relates to an apparatus to refurbish and repair engines, and in particular to an apparatus to remove undesirable deposits located on internal engine parts.

Many modern automotive engines utilize computer controlled fuel injectors to optimize fuel efficiency and minimize emissions. Generally described, the fuel injectors spray a precise and controlled amount of fuel toward an engine intake valve at an optimal time such that the fuel mixes with air and is drawn into the associated engine cylinder in a highly efficient and controlled manner. The timing and amount of fuel sprayed by the injectors is computer controlled to maximize air/fuel mixtures under a variety of operating conditions. Thus, engine performance is optimized to maximize fuel efficiency, power, and startability, while minimizing emissions, engine hesitation and stalling. This precise control becomes particularly important as engines are down-sized and therefore no longer have the reserve of horsepower to overcome minor problems. Further, modern consumers are becoming increasingly sensitive to insufficient horsepower.

About five years ago, a problem was discovered wherein carbon and other materials build up over time on the intake valves of an engine thereby decreasing engine efficiency. There is growing concern over this problem since the problem is particularly prevalent in engines that utilize fuel injectors to spray fuel onto the "backside" of the intake valve. Over time these deposits can become large enough to exhibit a choking effect upon the engine by restricting and disrupting the air flow into the engine cylinders. The amount of build-up can depend upon driving habits and the cleanliness of fuel used, but has been know to reach significant levels even after as little as three thousand miles.

However, performance problems can be experienced even before the deposits become large enough to restrict air flow. The deposits tend to absorb fuels with a sponge-like effect such that the air/fuel mixture is affected. Thus, initial injections of fuel are partially absorbed resulting in an air/fuel mixture that is too lean. Many engines have a fuel enrichment mechanism which operates similar to a choke to add "extra" fuel during initial start-up. The problems of engine hesitation and rough idling are particularly noticeable once the fuel enrichment mechanism is turned off and when the engine is still cold.

Further complicating the overall problem is the difficulty of repair. Typically, the intake manifold of the engine must be disassembled from the cylinder head and the cylinder head disassembled from the engine block so that the intake valves can be individually removed and cleaned. However, this is expensive and time consuming. Further, it is difficult to satisfactorily reassemble engines that have been fully disassembled. For example, it is common for reassembled engines to leak at the gasket between the cylinder head and the engine block, thus necessitating repeated tear-down and rebuild. Thus, complete disassembly often leads to further warranty, repair, and consumer dissatisfaction. As a result, dealerships and/or mechanics will undergo such a major repair only as a last resort, even after proper diagnosis of the problem has been done.

Thus, a tool is desired to remove undesired deposits on an intake valve or other selected internal engine part without requiring complete disassembly of an engine. Further, the tool must facilitate quick and efficient removal of the undesired deposits without undue risk of damage to the engine or risk of safety to the operator using the device.

SUMMARY OF THE INVENTION

The present invention is embodied in an apparatus for removing undesirable deposits on a part in an enclosure having at least one exposed passageway. The apparatus is adapted to dispense blast media through an exposed passageway and against the undesirable deposits. The apparatus further is adapted to mount to the enclosure and draw a vacuum to remove spent media and dislodged deposits therefrom.

According to one aspect of the invention, an apparatus to remove undesirable deposits includes a supply means for selectively injecting media and air through an exposed passageway in the enclosure, and removal means for removing the spent media and dislodged deposits therefrom through the same or another exposed passageway. The removal means includes a body having a port for drawing a vacuum to remove the media and dislodged deposits, and further includes an adjustable mount to provide universal mounting of the body to a range of opening sizes.

One application of the present invention is to remove undesirable deposits on a selected internal engine part of a partially disassembled engine. The apparatus includes a tank adapted to dispense blast media, a main conduit to deliver blast media through an exposed passageway on the engine, and a nozzle to direct the blast media against the undesirable deposits. The apparatus further includes a means for removing the spent blast media and dislodged deposits from the engine.

According to another aspect of the invention, a remote control is provided to cause the supply means to selectively switch between supplying blast media and unaltered air. The remote control is locatable adjacent the nozzle to facilitate use by an operator.

According to yet another aspect of the present invention, a pressure tank is provided for holding and mixing particles with pressurized air to create a media useful to remove undesirable deposits on a selected part. The pressure tank includes a cylindrical wall portion and tangentially connected air inlet and outlet ports that create a swirling pattern of air flow to gradually pick up and dispense the particles located in the tank thereby promoting a more uniform distribution of particles in the air.

The present invention includes several advantages over known art. Repair cost is reduced by reducing the extent to which an engine, or other enclosed apparatus, must be disassembled in order to effectively remove the undesirable deposits. This reduces repair time for disassembly, and also reduces subsequent repair time due to an inadequate reassembly of the engine. For example, inadequate assembly can result from an inadequate and leaky seal between the cylinder head and engine block of the reassembled engine. By use of the present invention, the intake manifold and the cylinder head do not need to be removed. Another advantage is the universal adapter that allows the device to universally adapt to differently sized openings on the engine, thus allowing one adapter to be used with a wide variety of different intake manifold designs. Still another advantage is the removable adapter that allows differently shaped adapters to be installed onto the device, for adapting the device to still other engine designs. Still another advantage is the spark-proof construction and operation which reduces the chance of accidental fire around the engine. Still another advantage is the remote control that can be located near the engine to facilitate control over the device by the operator. Also, with the universal attachment provided, there is no need to use additional fasteners or hardware that might get lost or left in cylinder head or intake runner. Still further, the apparatus is light weight, relatively easy to use, and is cost effective to use.

These and other features, objects, and advantages of the present invention will become apparent upon reading the following description thereof together with reference to the accompanying drawings in which:

DETAILED DESCRIPTION OF THE PREFERRED EMBODIMENT

Figure 1:
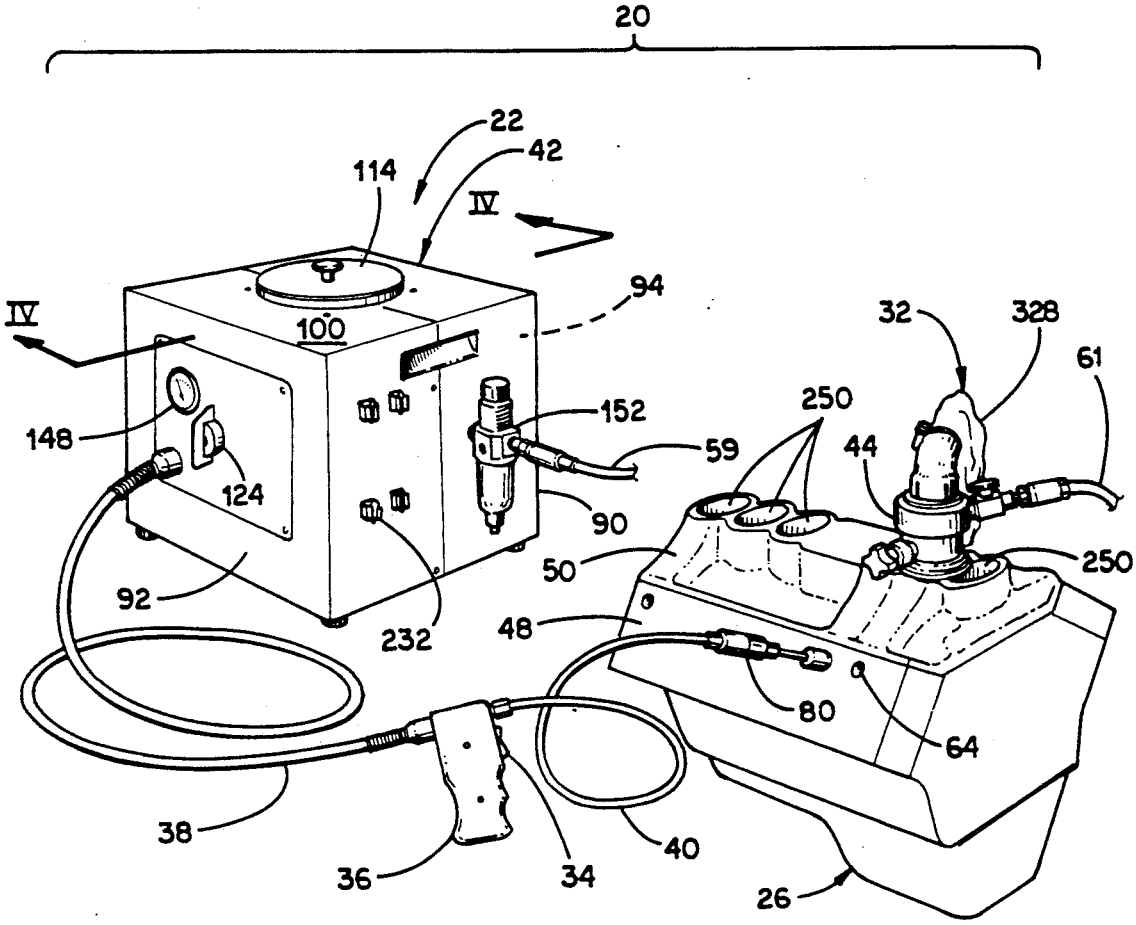
FIG. 1 is a perspective view of an apparatus embodying the present invention, the apparatus being connected to a partially disassembled engine.

Referring now to the drawings and the embodiments illustrated therein, an apparatus embodying the present invention is shown in the attached figures and is generally referred to as numeral 20. Apparatus 20 (FIG. 1) includes a blasting device 22 for conveying blasting media 24 (FIG. 3) to a partially disassembled engine 26 so as to abrasively break away undesirable deposits 28 from an intake valve 30 located in engine 26, and further includes a suction device 32 (FIG. 1) for drawing a vacuum to suction away the spent blast media and dislodged deposits as they collect in engine 26 during use of blasting device 22. Blasting device 22 is uniquely constructed so as to provide a spark-proof supply and delivery system to selectively convey blast media 24 or unaltered air to engine 26 in a manner that facilitates ease of use and safety. A remote control 34 located on hand grip 36 integrally attached to delivery hoses 38 and 40 enhances the control over blasting device 22 to facilitate its operation. Remote control 34 combines with supply system 42 to allow several intake valves 30 on partially disassembled engine 26 to be cleaned without repeatedly leaving engine 26 to fuss with turning the blast media supply system 42 on and off, or continually reloading the system. The suction device 32 also facilitates use of blasting device 22 by providing a spark-proof, compressed air actuated vacuum for drawing away spent blast media and dislodged deposit particles from engine 26. Further, suction device 32 includes an adjustable mount 44 that provides universal mounting of suction device 32 to a variety of differently sized openings, such that suction device 32 can be used on a variety of different engines without the need for a different adapter for each different engine configuration.

Figure 2:
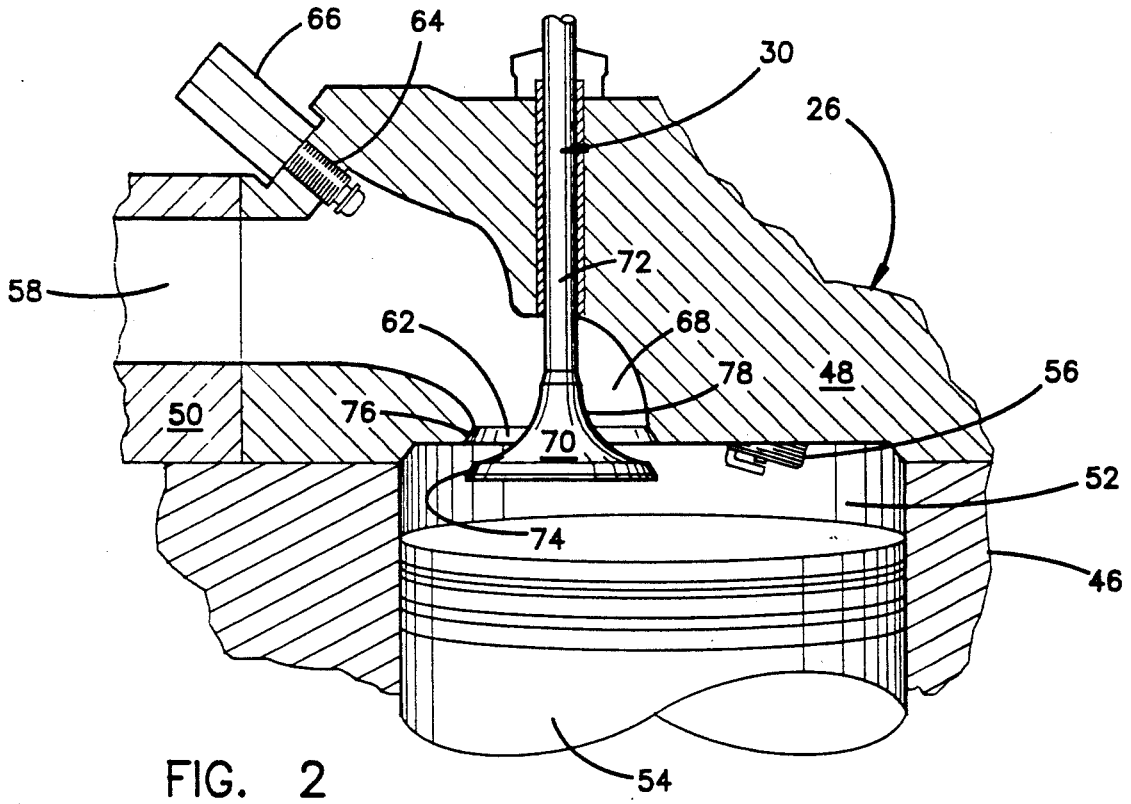
FIG. 2 is a schematic showing the general relationship of internal engine parts.

FIG. 2 schematically illustrates the general relationship between several internal parts within a properly operating engine 26. As shown, engine 26 is generally assembled with an engine block 46, a valve head 48 and an intake manifold 50. Valve head 48 sealingly closes the upper portion of multiple cylinder bores 52 in engine block 46. Each cylinder bore 52 is filled with a reciprocating piston 54. Positioned above each piston 54 within valve head 48 is an intake valve 30, an exhaust valve (not shown) and a spark plug 56. Intake valve 30 is slideably positioned within valve head 48 and cammed to reciprocatingly move between an open position allowing an air/fuel mixture to enter the compartment within cylinder bore 52 above piston 54, and a closed position wherein the valve is sealingly closed allowing piston 54 to compress the air/fuel mixture and burn same. An air intake passageway 58 is defined in intake manifold 50 and valve head 48 that allows air to enter past valve 30 through intake valve port 62 into cylinder bore 52. Valve head 48 includes an injector port 64 through which fuel injector 66 injects fuel. Fuel injector 66 is optimally attached to valve head 48 such that fuel injected by fuel injector 66 is sprayed toward the inlet side of intake valve 30 causing the fuel to mix with air entering through air intake passageway 58 generally in a mixing chamber 68. The quantity and timing of fuel injected by injector 66 is optimally controlled so as to maximize engine performance and efficiency under a variety of conditions, regardless whether engine 26 is cold or hot, and regardless whether the engine is operating at a slow or high speed.

Intake valve 30 includes an enlarged lower portion 70 connected to an elongated shaft 72. Enlarged lower portion 70 includes a flattened lip 74 that seals against seat 76 allowing intake valve 30 to sealingly close intake valve port 62 creating an airtight closure over cylinder bore 52. Enlarged lower portion 70 also includes an arcuate surface 78 on its "backside" or intake side which facilitates distribution and mixing of air and fuel as they flow into cylinder bore 52.

Figure 3:
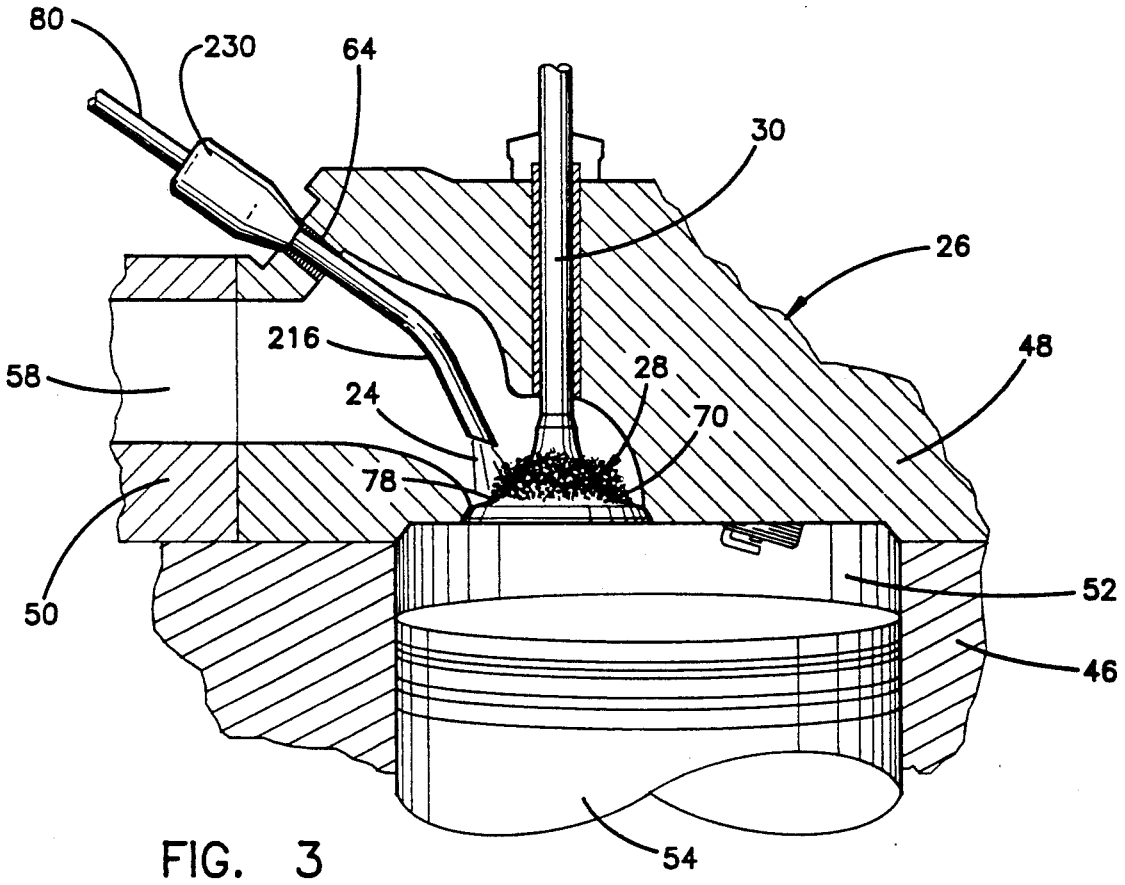
FIG. 3 is a skematic of an intake valve having an undesirable deposit thereon, with the nozzle tip of the present apparatus shown as positioned for use thereon.

As illustrated in FIG. 3, undesirable deposits 28 of carbon and similar matter can build up on the intake side of enlarged lower portion 70 of intake valve 30 after a period of use of engine 26. The amount of deposit and formation, can vary greatly depending upon the specific characteristics of an engine, a given driver's habits, the cleanliness and adequacy of fuels used, and the like; however, significant deposits have been found after only 3,000 miles of use. As fuel is sprayed by injector 66, it collects around arcuate surface 78 on the underside/inlet side of enlarged lower portion 70 of intake valve 30. By design, injectors 66 are focused toward arcuate surface 78 such that air flowing past surface 78 tends to mix with and pick up an optimum and controlled amount of fuel. As can be seen in the illustration, deposits 28 can grow to such an extent that the air flow past intake port 62 becomes partially blocked or disturbed, thus starving engine 26 of air and fuel.

However, even before intake port 62 becomes blocked, deposits 28 begin to affect engine performance. Initially, air flow is affected and the flow pattern is not as efficient as designed. Also, deposit 28 can act like a sponge and soak up fuel so as to distort the air/fuel ratio. This, for example, leads to a lean air/fuel mixture during cold starts after the fuel enrichment cycle has been completed, which in turn leads to rough and stumbling engine operation with inadequate power and hesitation during acceleration.

As illustrated in FIG. 3, apparatus 20 is designed to remove deposit 28 from arcuate surface 78 of intake valve 30 and the related areas. Engine 26 is prepared by partially disassembling it with injectors 66 being removed to expose an injector port 64, and an upper intake plenum (not shown) being removed to expose openings 250 of air intake passageway 58 on intake manifold 50 (FIG. 1). Also, the cam shaft (not shown) of engine 26 is rotated so that intake valve 30 is fully seated against valve seat 76 so that cylinder bore 52 is sealed off (FIG. 3). This prevents debris from entering cylinder bore 52 during operation of apparatus 20. A nozzle tip or wand 80 of blasting device 22 is positioned through injector port 64 to direct blast me ia 24 against undesirable deposit 28. Simultaneously, suction device 32 is operably connected to exposed opening 250 of passageway 58 (FIG. 1). Compressed air supply lines 59, 61 are then attached to both blasting device 22 and suction device 32 (FIG. 1), and apparatus 20 is then otherwise readied for use as described below.

Supply system 42 (FIG. 4) is comprised of a box-like housing 90 with front 92, back 94, sides 96, 98, top side 100, and bottom 102 including foot supports 103. Top side 100 includes a circular opening 104 through which a blast particle hopper 106 is positioned. Hopper 106 is concially-shaped in its lower half 108 and includes upstanding cylindrical sides 110 in its upper half that include attachment tabs 112 for secure attachment to top side 100. Optimally, hopper 106 is sized to hold a sufficient amount of blast particles 116 to fill pressure tank 128 located therebelow. A cover 114 mateably closes on upstanding cylinder sides 110, cover 114 including a handle 115 and being removable so that blast particles 116 can be conveniently added to hopper 106. The lower end of hopper 106 includes an outlet opening 118 that is operably mechanically connected to a ball-type shutoff valve 120. Ball shutoff valve 120 is operably connected to a shaft 122 and handle 124, shaft 122 extending from ball shutoff valve 120 through front side 92. With ball shutoff valve 120 in the open position, blast particles 116 are allowed to fall through a vertically adjustable nipple 126 and blast particle load/inlet port 127 into pressure tank 128. It is contemplated that blast particles 116 will be crushed walnut shells having a mesh size of about #12/20. Walnut shells are soft enough to prevent undesired scoring of intake valves 30 and specifically cylinder bore 52 if they fall therein, but also are combustible and will burn away as an engine is started. However, it is contemplated that soft plastic pellets or other blasting media may also be used.

Pressure tank 128 includes cylindrical sides 130 and planar top 132 to form with bottom 102 an air-tight and pressurizable vessel. Planar top 132 includes an internal nut 134 located at load/inlet port 127. Vertically adjustable nipple 126 is threadably installed in welded internal nut 134 and includes an upper lock nut 136 to secure nipple 126 in place. Vertical adjustment of nipple 126 allows proper positioning of ball shutoff valve 120, shaft 122, and hopper 106 with respective to housing 90. Brackets 138 and 140 are welded to the top exterior side of planar top side 132. Brackets 138 and 140 reinforce planar top 132 to prevent bulging when pressure tank 128 is pressurized, and also provide attachment sites for articles that are to be attached within housing 90.

Near the top of cylindrical sides 130 (FIGS. 4 and 5) are tangential air inlet 142 and tangential air outlet 144. Inlet 142 and outlet 144 are optimally located to create a swirling action within pressure tank 128 to optimize the distribution of blast particles 116 to form blast media 24 as compressed air enters pressure tank 128, circulates therein, and exits through outlet 144. Inlet 142 includes an air filter 143 to prevent debris or oily air from entering inlet 142. Inlet 142 and outlet 144 are positioned adjacent the top of cylindrical sides 130 and slightly horizontally above the lower end of nipple 126 such that inlet 142 and outlet 144 will not tend to be plugged b blast particles 116 when tank 128 is filled. Restated, nipple 126 extends low enough such that blast particles 116 added to pressure tank 128 will never rise above and close off inlet 142 and outlet 144. A "gate-type" check valve 160 is serially connected to outlet 144. Check valve 160 allows blast media 24 to exit outlet 144 and flow into main conduit 178 without undue disruption of the flow of blast media 24. Simultaneously, check valve 160 limits the back flow of blast media through secondary inlet port 161 to unaltered air control valve 156 as blast media 24 exits outlet 144. Alternatively, the gate (not shown) within check valve 160 pivots to prevent backflow from secondary inlet port 161 into pressure tank 128 through outlet 144, thereby preventing inadvertent pressurizing of tank 128. This is important since, if tank 128 is pressurized it may "spit" additional blast particles 116 into main conduit 178 as unaltered air is turned off and tank 128 depressurizes. In other words, every time an operator finished blowing out the spent blast particles from engine 26 and turned off the unaltered air, tank 128 would depressurize and potentially "spit" in a few more particles 116. The control of and path of pressurized air and blast media 24 is more clearly described below with reference to FIG. 9.

Figure 4:
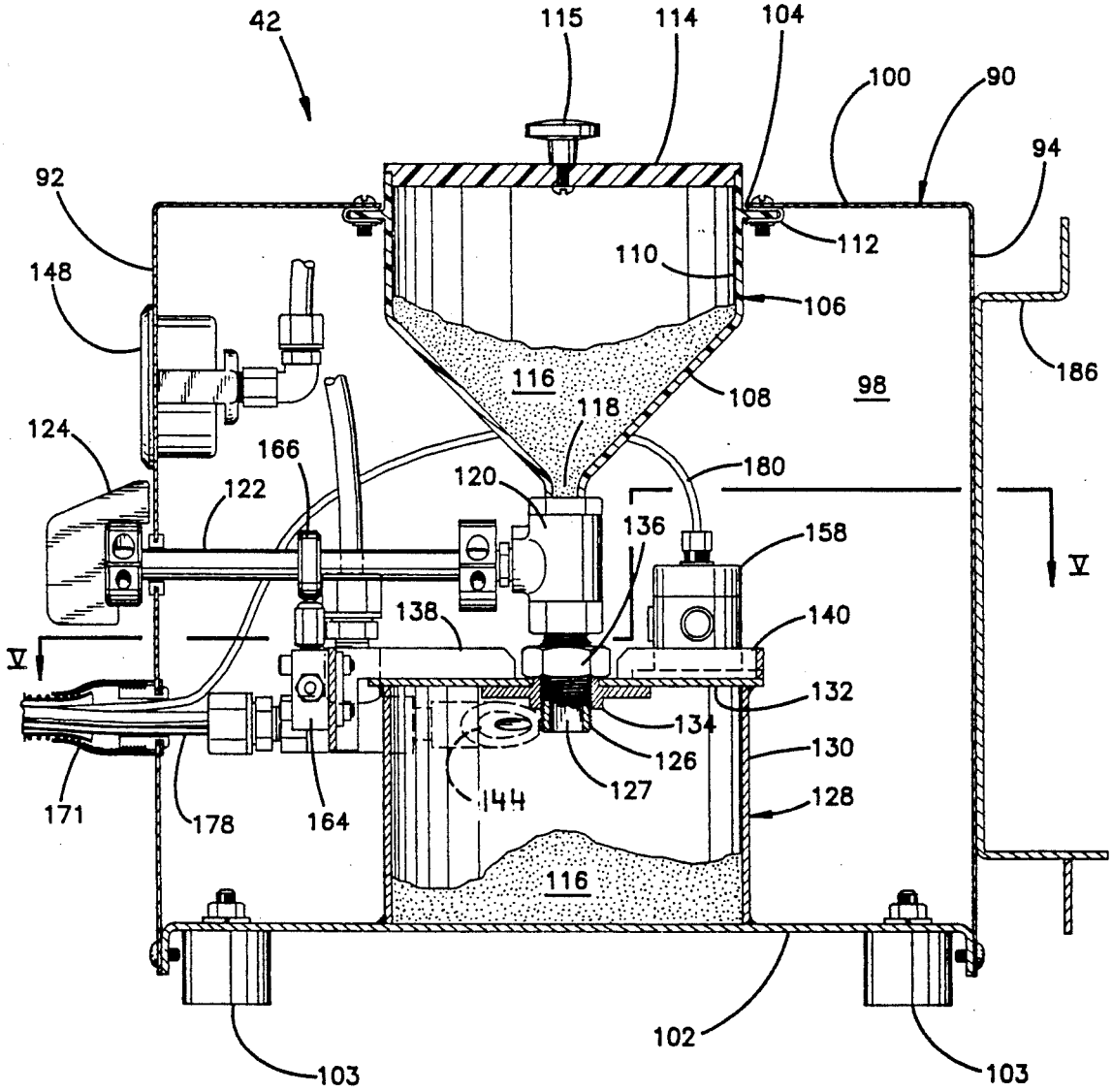
FIG. 4 is a cross-sectional view taken along the plane IV—IV in FIG. 1.
Figure 5:
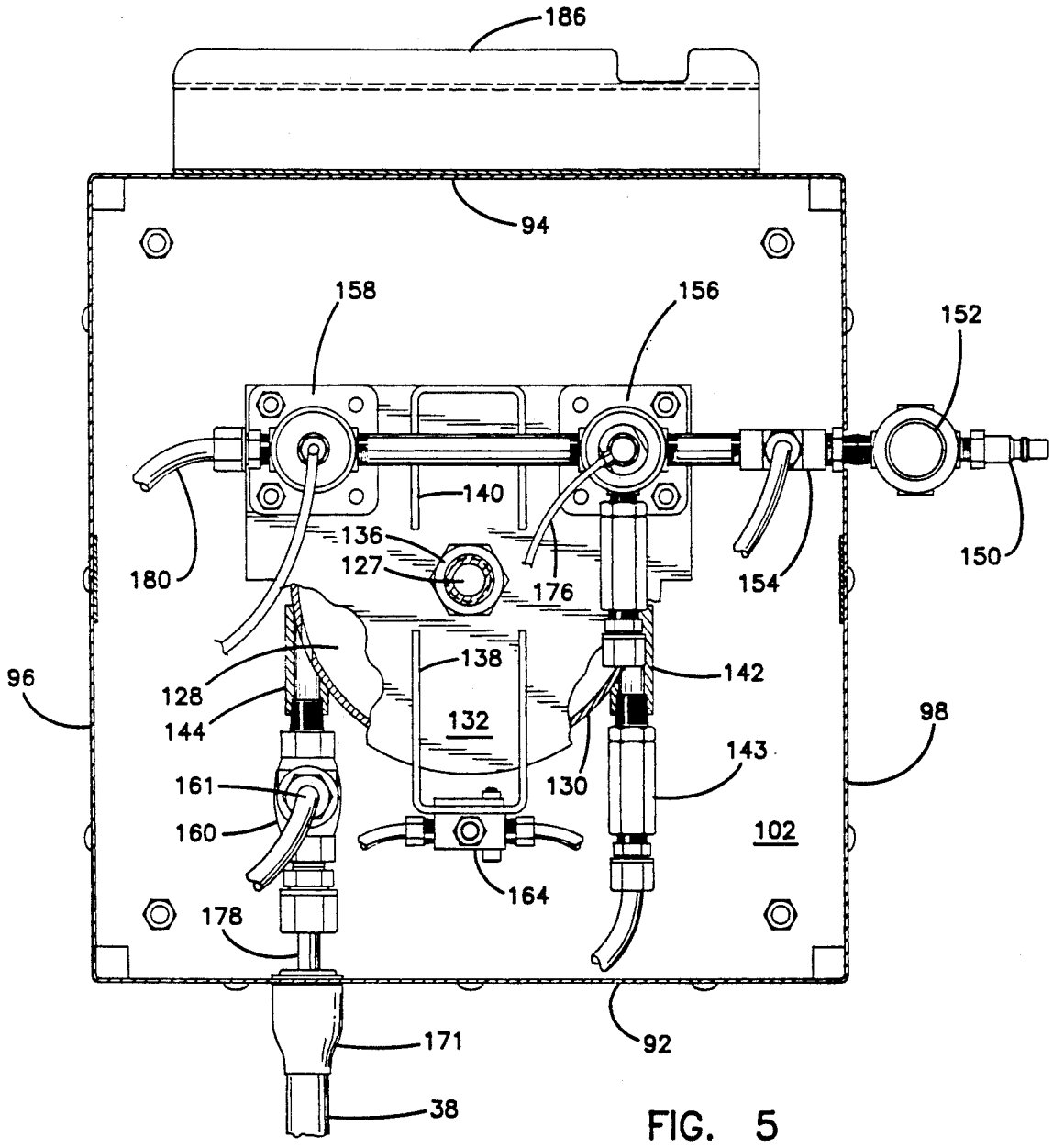
FIG. 5 is a cross-sectional view of the supply housing taken along the plane V—V in FIG. 4.
Figure 9:
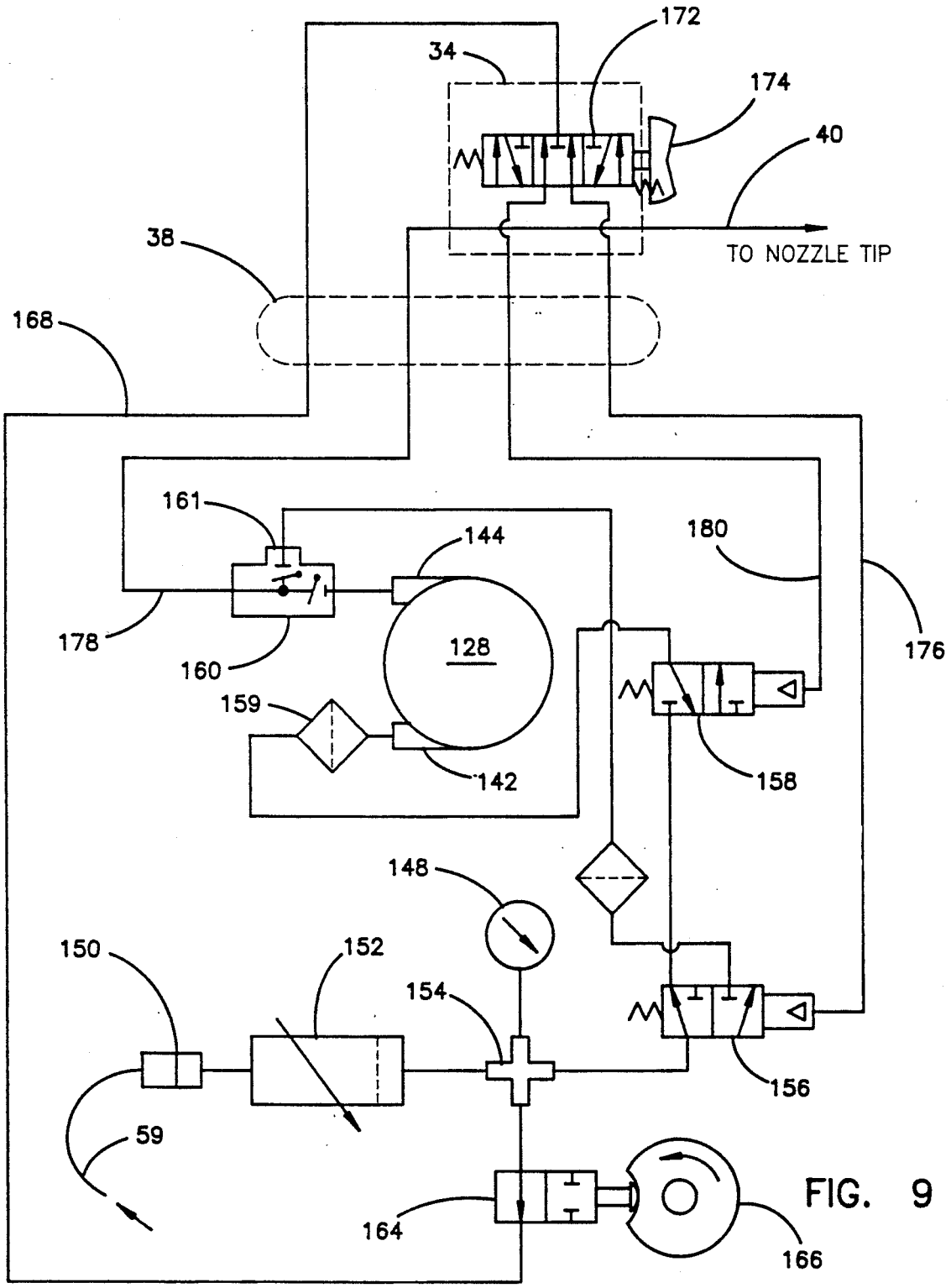
FIG. 9 is a pneumatic diagram.

As shown in FIG. 5, supply system 42 includes a compressed air quick disconnect 150 and air pressure regulator 152 mounted exteriorly on side 98. Operably serially connected inside thereof, is a four-port cross connector 154. Compressed air is communicated through quick disconnect 150, air pressure regulator 152, and four-port cross connector 154 to unaltered air control valve 156 and air pressure gage 148. The actual air lines for communicating compressed air have been removed to simplify the FIGS. 4–5, but are schematically indicated in FIG. 9. Pressure gage 148 is mounted on front side 92 (FIG. 4) for ease of visual access. Compressed air is controllably distributed from unaltered air control valve 156 to either of blast media control valve 158 or secondary inlet 161 of backflow "gate-type" check valve 160. "Gate-type" check valve 160 prevents compressed air from entering pressure tank 128 backwardly through air outlet 144. Blast media control valve 158 is operably connected to communicate compressed air to tangential air inlet 142 of pressure tank 128.

Compressed air to be used as control air is also distributed from a four-port cross connector 154 to a safety valve 164. A cam 166 (FIG. 4) located on shaft 122 is operably connected to safety valve 164 such that safety valve 164 only permits control air to pa s through safety valve 164 if cam 166 and ball shutoff valve 120 are in the proper operational position. Restated, safety valve 164 prevents control air from activating pressure tank 128 when ball shutoff valve 120 is open, thus preventing blast particles 116 from being blown upwardly through hopper 106. Control air is communicated from four-port cross connector 154 through safety valve 164 and through control air supply line 168 (FIG. 6) to remote control 34 on hand grip 36.

Control air supply line 168 (FIG. 6) extends through delivery hose or conduit 38 to hand grip 36. Hose 38 is a multi-conduit flexible hose with flexible outer sheathe 170. At both ends of hose 38 is a flexible protector 171 to protect against over-rotation and damage to hose 38. Control air supply line 168 extends through hose 38 into a remote control valve 172 located on the hollow interior portion of hand grip 36. Hand grip 36 provides a conveniently shaped lower portion 184 that is operably shaped to comfortably receive the palm and hand of a user, and positions the fingers of the operator adjacent a three position toggle selector switch 174 such that switch 174 is convenient and easy to use.

Figure 6:
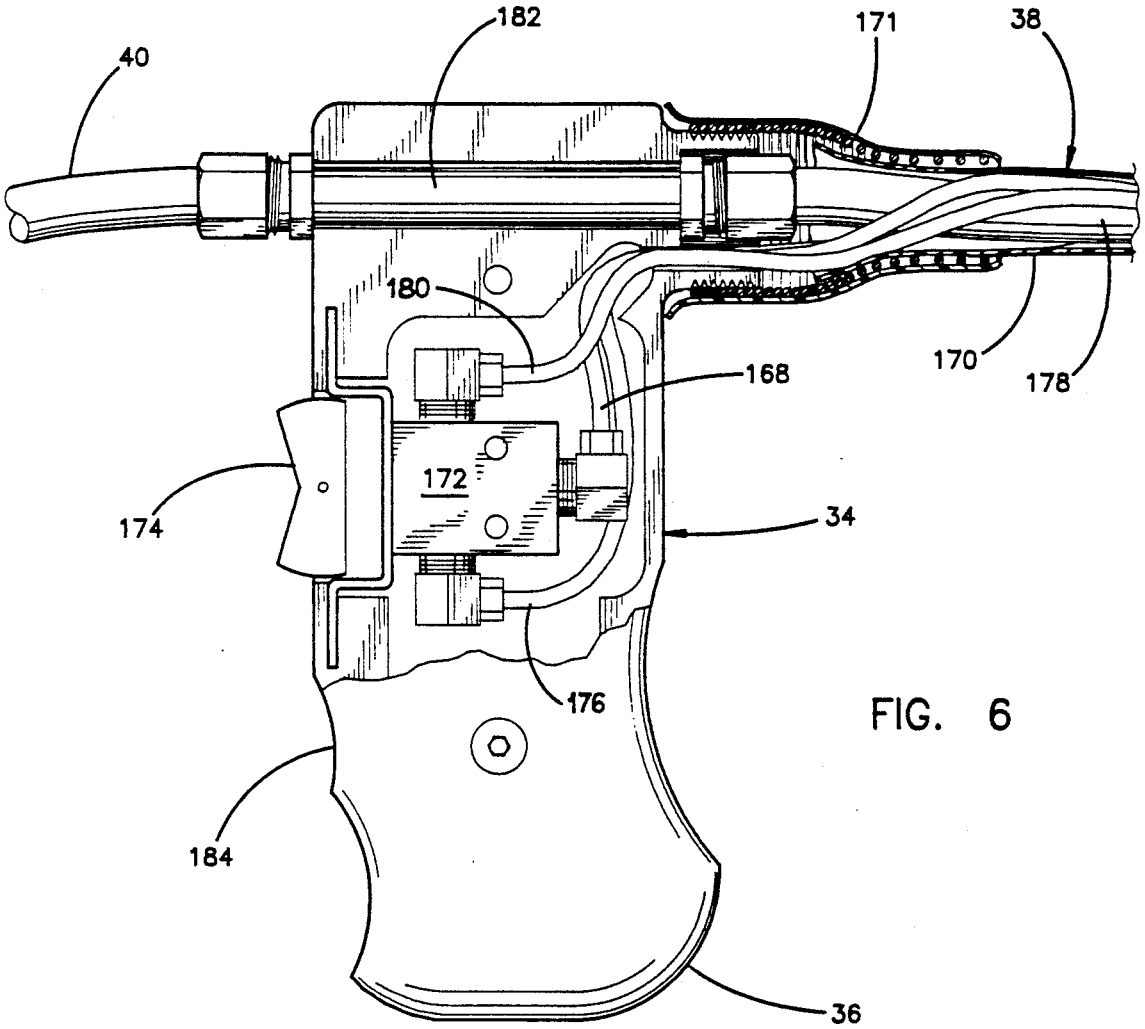
FIG. 6 is a partially broken away side view of the hand grip in FIG. 1.

Remote control valve 172 is operably connected to a three position toggle selector switch 174, toggle switch 174 being pivotable from a neutral position in either a first or second direction. In the neutral position, control air from control air supply line 168 is deadheaded. In the first direction, toggle switch 174 actuates remote control valve 172 to communicate the control air flowing through control air supply line 168 to a control air return line 176, control air return line 176 operably connected to unaltered air control valve 156 (FIG. 5). This actuates unaltered air control valve 156 to pneumatically switch an allow compressed air to travel through secondary inlet port 161 in backflow check valve 160 directly into main conduit 178. Toggling of toggle switch 174 in the opposite second direction communicates control air from control air supply line 168 through control air return line 180 to blast media control valve 158 (FIG. 6). This actuates blast media control valve 158 (FIG. 5) such that compressed air is communicated to tangential air inlet 142 pressurizing pressure tank 128. In turn, air swirls within pressure tank 128 so as to pick up blast particles 116 in a dispersed manner forming blast media 24. The blast media 24 then exits through tangential air outlet 144 and gate-type backflow check valve 160 into main conduit 178. Due to the design of toggle switch 174, only one of blast media 24 or unaltered air is selectable. Blast media 24 or unaltered air flows through main conduit 178 to hand grip 36 (FIG. 6) where it is jumpered through handle grip 36 by nipple 182 at an upper end of hand grip 36 to a second flexible delivery hose 40. Conveniently, hoses 38 and 40 can be wrapped and stored on bracket-like holders 186 on back 98 of housing 90 (FIGS. 4 and 5). It is contemplated that holders 186 could be located in alternative locations such as on top side 100.

Figure 7:
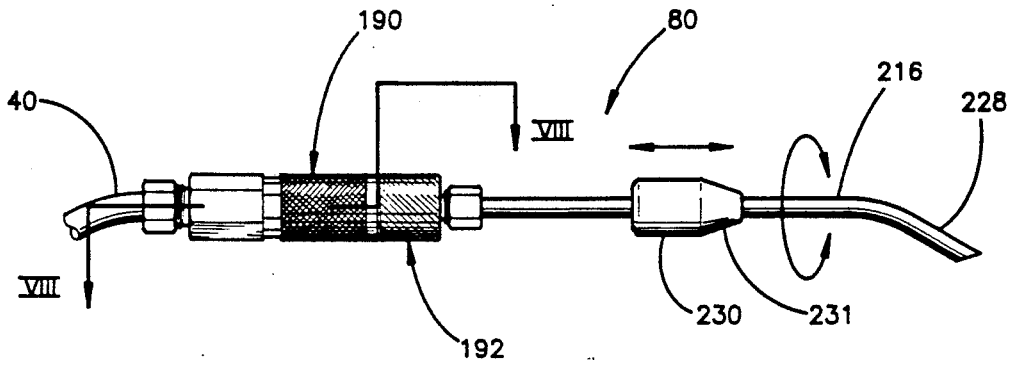
FIG. 7 is a side view of the nozzle in FIG. 1.
Figure 8:
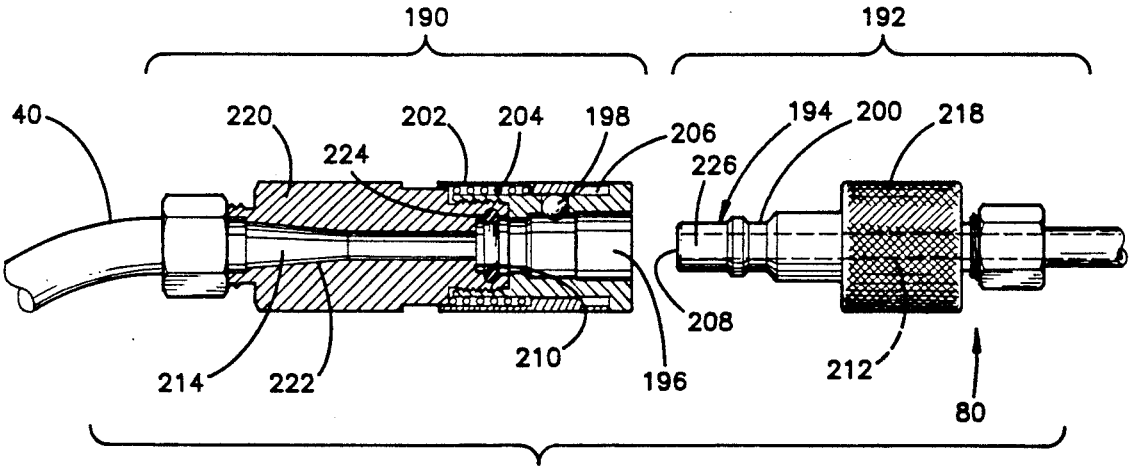
FIG. 8 is a partial cross-section taken through the plane VIII—VIII in FIG. 7.

On the remote end of hose 40 (FIGS. 7 and 8) is a female quick disconnect 190. Female quick disconnect 190 is designed to mateably receive and couple to a male quick disconnect 192 on nozzle tip or wand 80 Female quick disconnect 190 mateably joins with male quick disconnect 192 by engagement of male protrusion 194 within female recess 196. Retention ball 198 of female quick disconnect 190 is sized to releasably but securely engage an external groove 200 of male protrusion 194. A sleeve 202 is slideably moveable on female quick disconnect 190 against bias spring 204 to release retention ball 198 partially into recess 206 on sleeve 202, thereby permitting disengagement of retention ball 198 with external groove 200. Male protrusion 194 includes a blunted end 208 that abuts ledge 210 in female quick disconnect 190. Internal bores 212 and 214 of male and female quick disconnects 192, 190 respectively join with delivery hose 40 and elongated nozzle tip extension 216 to form a substantially continuous and uniform internal bore with no abrupt transitions so that blast media 24 flows directly and uniformly therethrough without undue disturbance or wear on the associated parts. The internal bores 212, 214 are defined by the walls 218, 220 of male and female quick disconnects 190, 192. Internal bore 214 includes a transition zone 222 wherein the diameter of internal bore 214 is gradually reduced. Near the input end of female recess 196 is an O-ring 224 that sealingly engages the smooth outer diameter 226 on the terminal end of male protrusion 194, thereby providing an air-tight seal between female quick disconnect 190 and male quick disconnect 192.

Nozzle tip or wand 80 (FIG. 7) includes an elongated nozzle tip extension 216 that is substantially an elongated rigid tubular member with an end portion 228 that is slightly laterally bent from the longitudinal direction of extension 216. End portion 228 permits nozzle tip 80 to direct blast media 24 in different directions a nozzle tip 80 and specifically male quick disconnect 192 is rotated within female connector 190. An externally mounted seal 23 is slideably positioned on the outer diameter of elongated nozzle tip extension 216 such that external seal 230 can slide fore-to-aft and rotate on extension 216. Seal 230 is designed with a tapered portion 231 to mateably seal against the exposed injector port 64 (FIG. 3), thereby forcing blast media 24 and unaltered air delivered by supply system 42 through nozzle tip 80 to exit through air intake passageway 58 from engine 26. Though only one nozzle tip 80 is shown, it is anticipated that multiple nozzle tips can be provided if needed. As indicated in FIG. 1, multiple nozzle tips 80 can be stored on clip brackets 232 on side 96 of housing 90.

FIG. 9 is a pneumatic schematic showing the pneumatic connections of the valves and associated parts thereof. Compressed air enters serially through quick disconnect 150, pressure regulator valve 152 to four-port cross connector 154. Pressure gage 148 is connected to four-port cross connector 154 and mounted exteriorly on front 92 of housing 90 so that pressure is visually displayed in a readily viewable location. Compressed air is also communicated from four-port cross connector 154 to unaltered air control valve 156. Unaltered air control valve 156 is in a normally open position for communicating air to blast media control valve 158, but is actuatable by control air return line 176 to move to a shifted position wherein air is communicated to secondary input port 161 and gate-type check valve 160. This allows unaltered compressed air to be communicated through gate-type check valve 160 and through main conduit 178 in hoses 38 and 40 to disassembled engine 26 as desired. Gate-type back flow check valve 160 prevents unaltered air from pressurizing pressure tank 128 through tangential air outlet 144. Thus, tank 128 does not undesirably depressurize and "spit" blast particles 116 into engine 26 as the unaltered air valve 156 is switched off.

Compressed air can also be communicated from four-port cross connector 154 through unaltered air control valve 156 to blast media control valve 158. Blast media control valve 158 is normally closed, but actuatable to convey compressed air through filter 159 to tangential air inlet 142. This pressurizes tank 128 creating a swirling flow pattern of air around pressure tank 128. The swirling action causes the compressed air to pick up blast particles 116 in a dispersed and substantially uniform manner such that the blast particles 116 mix with compressed air to form blasting media 24. Blast media 24 is then conveyed out through tangential air outlet 144 and check valve 160 into main conduit 178 within delivery hoses 38 and 40.

Control air (FIG. 9) is also communicated from four-port cross connector 154 through safety valve 164. Safety valve 164 is operably connected to cam 166 such that safety valve 164 is only open if ball shutoff valve 120 is in a closed position. This prevents pressure tank 128 from being pressurized when ball shutoff valve 120 is open, thereby preventing the problem of backflow of air and blast particles 116 upwardly through shutoff valve 120 into hopper 106 (FIG. 4). With safety valve 164 in the operable position (FIG. 9), control air passes through safety valve 164 through control air supply line 168 to remote control valve 172 located in handgrip 136. A toggle switch 174 located in handgrip 36 is operably connected to remote control valve 172 such that control air from supply line 168 can be selectively communicated to either of control air return lines 176 or 180 by us of toggle switch 174. Communication of control air into control air return line 176 communicates control air to unaltered air control valve 156. Thus, control valve 156 is activated and unaltered compressed air is routed into main conduit 178 to be communicated through hoses 38 and 40 to nozzle tip 80 and engine 26. Alternatively, control air supply is selectively routed by remote control valve 172 into control air return line 180 which selectively activates blast media control valve 158. Blast media control valve 158 is actuated to communicate compressed air into pressure tank 128, thereby causing a swirling flow of air to pick up blast particles 116, form blast media 24, and exit through tangential air outlet 144 into main conduit 178 wherein it is communicated through delivery hoses 38 and 40 to nozzle tip 80 and engine 26.

Figure 10:
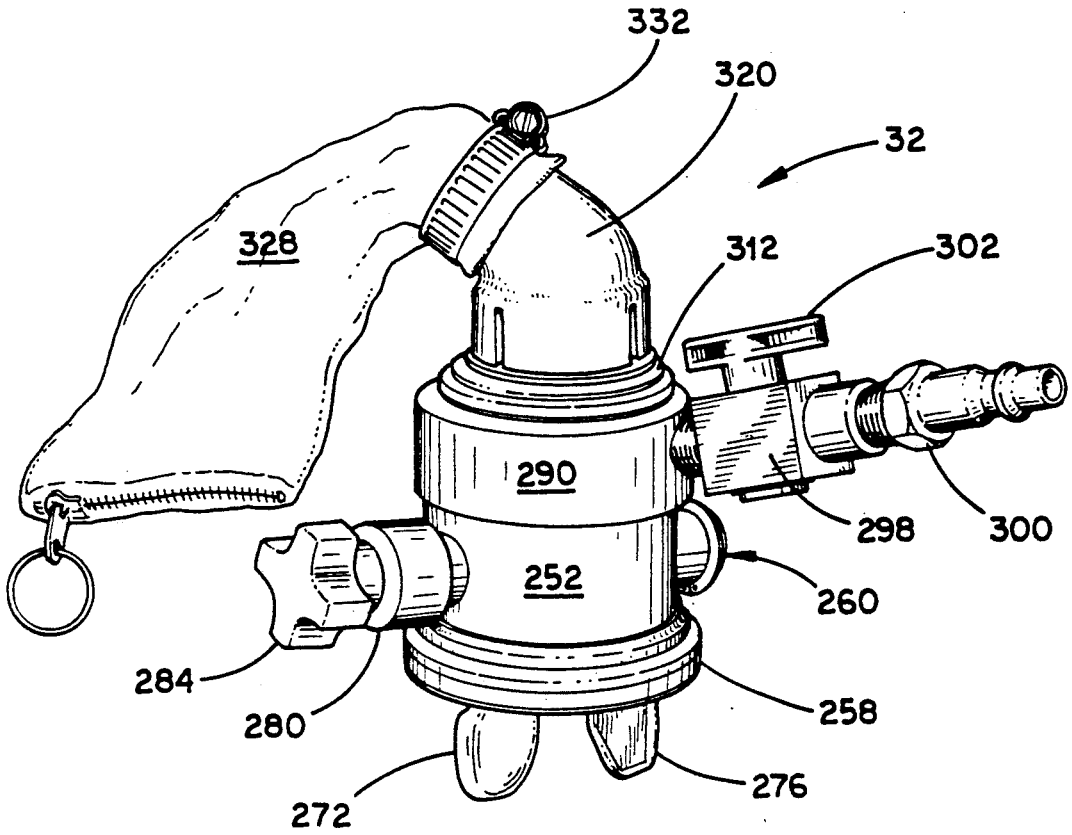
FIG. 10 is a perspective view of the suction device in FIG. 1.

A suction device 32 (FIGS. 10–12) is designed to cooperate with blasting device 22, suction device 32 sealingly attaching to exposed opening 250 on intake manifold 50 (FIG. 1). Suction device 32 (FIG. 11) is designed to create a vacuum such that spent blast media and undesired deposits that have been broken loose from intake valve 30 are suctioned through passageway 58 and removed from engine 26. Suction device 32 includes a body 252 with an internal passageway 254 extending upwardly therethrough. Body 252 includes a lower end 256 that mateably receives a removable compressible seal 258 so that body 252 can mateably and sealingly set on exposed opening 250.

Transversely mounted in body 252 and extending transversely through internal passageway 254 is a gripper assembly 260. Gripper assembly 260 includes a tube 262 slideably transversely mounted within body 252. An internal nut 264 is slideably mounted within the inner diameter of tube 262, nut 264 including a threaded internal bore 266. The lower edge of tube 262 includes a slot 268. A first gripper 270 is securely attached to nut 264 and extend downwardly through slot 268 through the lower end of internal passageway 254 and below seal 258. First gripper 270 includes a coated end 272 that extends downwardly into air intake passageway 58 as installed. Coated end 272 is coated with resilient material for gripping, such as that sold under the tradename "PLASTISOL". The resilient material on coated end 272 also reduces the chance of undesirable scoring or scratching of finished surfaces on engine 26. A second gripper 274 is securely attached to tube 262 and extends downwardly adjacent slot 268. Second gripper 274 similarly includes a coated end 276 and similarly extends downwardly into passageway 58 parallel to first gripper 270. On one end of tube 262 is a retaining ring 278 and opposingly on the other end of tube 262 is a threaded cap 280, retaining ring 278 and threaded cap 280 securely retaining external tube 262 within body 252. Threaded cap 280 includes a centrally located aperture which receives threaded shaft 282. Threaded shaft 282 extends inwardly within tube 262 and threadably engages nut 264. A handle 284 is attached to the outer end of threaded shaft 282. By gripping handle 284, external tube 262 and specifically first and second grippers 270 and 274 can be laterally located within body 252 and air intake passageway 58. As handle 284 and specifically threaded shaft 282 are rotated clockwise, nut 264 is slideably laterally moved within tube 262 causing first and second grippers 270 and 274 to spread apart and grip the interior of air intake passageway 58. By pushing downwardly on body 252 as grippers 270 and 274 are spread, compressible seal 258 is compressed and body 252 is sealingly locked onto intake manifold 50.

Mounted exteriorly on the upper portion of body 252 is a distribution collar or ring 290. Distribution collar 290 is constructed to slip downwardly onto body 252 and be securely held in place by retaining ring 312. Distribution collar 290 is sealingly mounted on body 252 by O-rings 292, 294 such that it can pivotally rotate on body 252. Distribution collar 290 has a compressed air inlet port 296 on one side thereof. Compressed air inlet port 296 is threaded such that a shutoff valve 298 and quick disconnect 300 can be operably connected thereto. Shutoff 298 includes a handle 302 for turning shutoff valve to a closed position thereby closing off the compressed air without disconnecting the shop compressed air line. Compressed air inlet port 296 is connected to a circular channel or passageway 306. Channel 306 extends fully around body 252 and communicates with a channel or passageway 308 on body 252. Channel 308 includes passages 310 which are oriented generally diagonally upwardly into internal passageway 254 of body 252. Multiple passages 310 are located around channel 308 and oriented so that an effective vacuum is created within body 252 to draw air upwardly from air intake passageway 58 and intake manifold 50 upwardly through internal passageway 254 in body 252 of suction device 32. Since distribution collar 290 is rotatable on body 252, compressed air shutoff 298, compressed air quick disconnect 300, and the compressed air hose associated therewith can be oriented in substantially any direction desired. Also, quick disconnect 300 allows the compressed air hose connected therewith to rotate on quick disconnect 300 such that the compressed air hose does not twist or bind on body 252 as installed on engine 26. It should be noted that quick disconnect 300 is substantially similar to male quick disconnect connector 192 or a similar shop-type compressed air connector equivalent.

An air outlet elbow 320 snappably attaches to the top of body 252 above distribution collar 290 and sealingly onto "O"-ring 321. Notches 322 in the lower end of outlet elbow 320 engage a flange 324 on the exterior outer diameter at the top of body 252. Passageway 326 extends through air outlet elbow 320 and aligns with internal passageway 254 of body 252. A filter bag 328 is mateably releasably coupled to the upper exit end 330 of elbow 320 by a hose clamp 332 or the like. Filter bag 328 is constructed of a cloth-like filtering material to catch debris as it is suctioned from engine 26. A resilient flap 333 made of rubber or the like pivotally moves allowing blast media and debris to enter bag 328, but pivotally closes to prevent backflow out of bag 328.

Removable compressible seal 258 (FIG. 12) is shaped to sealingly engage the exposed opening 250 of air intake passageway 58. The shape of a typical of such exposed openings is shown by the phantom line 340. In the embodiment shown, compressible seal 258 has an oblong inner diameter 334 and is made of a compressible sponge or foam-like material. Additionally, the upper surface (FIG. 11) is designed with an upper lip 336 designed to slideably resiliently engage the lower end of body 252 so that seal 258 is readily replaceable.

OPERATIONS

Having described the components of apparatus 20 and the interrelationship thereof, the advantages, use, and operation of the present apparatus embodying the present invention should be obvious to one skilled in the art. For thoroughness, the operation is set forth as follows.

Suction device 32 (FIGS. 10 and 11) is fully assembled with body 252 and associated components thereon being fully assembled and secured to form suction device 32. An operator grips handle 284 and rotates threaded shaft 282 such that first and second grippers 270 and 274 are sufficiently closed to fit within the exposed opening 250 of intake passageway 58 on partially disassembled engine 26. Also, blasting device 22 (FIGS. 4 and 5) is prepared by loading blast particles 116 into hopper 106, and allowing particles 116 to flow through ball shutoff valve 120 and nipple 126 into pressure tank 128. Ball shutoff valve 120 is then closed such that blasting device 22 is ready for use. Compressed air is then attached to compressed air quick disconnect 150. It is contemplated that the operating pressure of blasting device 22 will be optimally preset by the manufacturer at about 75 to 100 PSI, but will work down to about 60 PSI. The maximum operating pressure is contemplated to be about 100 PSI. Blasting particles 116 are contemplated to be a soft pellet type material such as walnut shell particles sized at a mesh size of about #12/20.

Initially, an engine 26 is diagnosed with the problem such as by using a scope (not shown) to peer through a spark plug port (not shown) so that the undesirable deposits 28 (FIG. 3) on intake valves 30 are found. Engine 26 is then partially disassembled (FIGS. 1 and 3) with upper intake plenum (not shown) and other accessories and parts on engine 26 removed so as to expose the air intake passageway 58 and injector ports 64.

Figure 11:
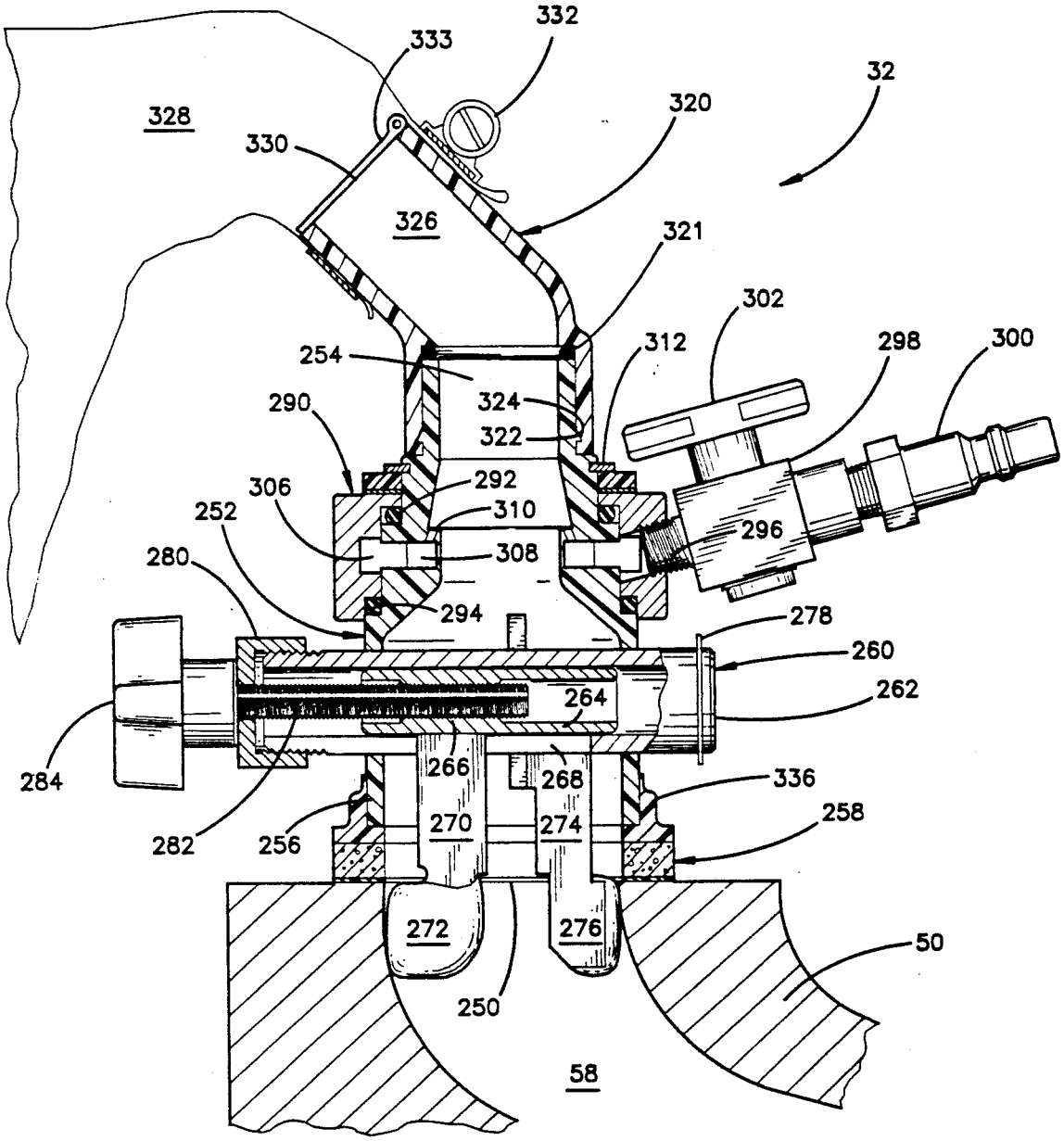
FIG. 11 is a side elevational view of the suction device in FIG. 10.
Figure 12:
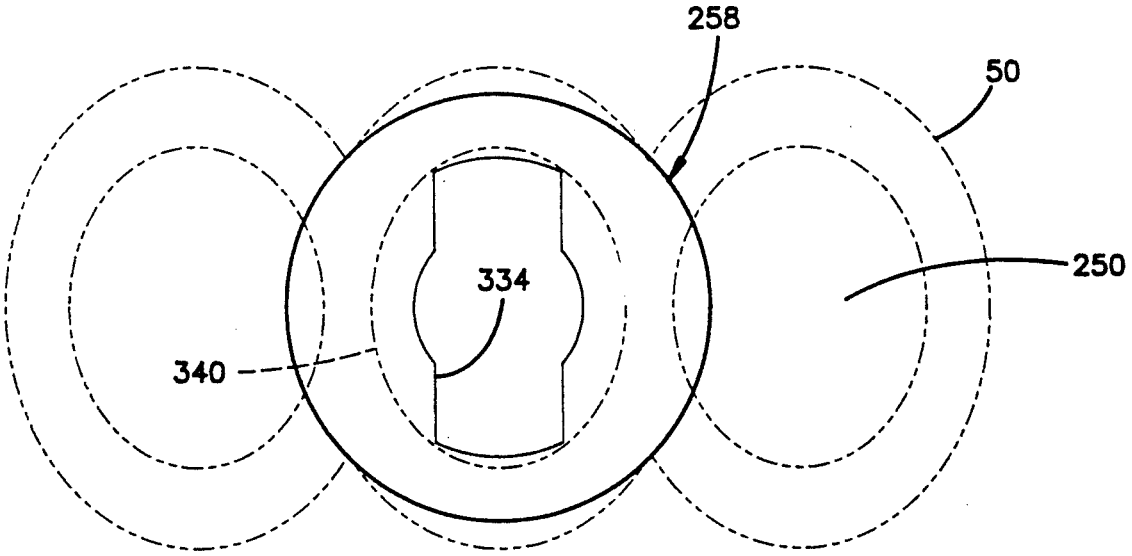
FIG. 12 is a plane view of the removable compressible seal in FIG. 10.

Suction device 32 is then placed on the exposed opening 250 of air intake passageway 58 (FIG. 11). Suction device 32 is pressed downwardly to compress seal 258 onto the marginal surface around exposed opening 250 of air intake passageway 58. While pressing downwardly, handle 284 is then twisted such that first and second grippers 270, 274 are spread, thereby causing them to grippingly sealingly secure suction device 32 on engine 26 over the selected exposed opening 250. Shutoff 298 can then be turned on by handle 302 so as to create a suction within body 252 by causing air to flow upwardly into filter bag 328.

The mechanic or operator grips nozzle tip or wand 80 at external seal 230 (FIG. 3) and places nozzle tip extension 216 through injector port 64 into mixing chamber 68 adjacent the subject intake valve 30. The end portion 228 of nozzle tip 80 is thus positioned adjacent the undesirable deposits 28 on intake valve 30. The operator then grips hand grip 36 with a second hand so that the operator's fingers are positioned adjacent toggle switch 174. The operator is now ready to begin application of blasting media 24 against deposits 28 so as to remove them from intake valve 30.

With suction device 32 activated to begin the vacuuming action, an operator presses toggle switch 174 so as to selectively actuate supply system 42 to supply blasting media 24. Pressing of toggle switch 174 in the proper direction communicates control air from control supply line 168 to control air return line 180 thus switching on blast media control valve 158 (FIG. 9). Blast media control valve 158 thereby shifts and causes compressed air to pressurize pressure tank 128. Compressed air flows in through tangential air inlet 142 and swirlingly flows around pressure tank 128 such that blast particles 116 are picked up in a substantially uniform and distributed manner to form blasting media 24. Blasting media 24 is then conveyed out tangential outlet 144 and gate-type check valve 160 through main conduit 178 in hoses 38 and 40 to nozzle tip 80. Blast media 24 is directed against deposits 28 gradually causing them to break loose from intake valve 30.

As spent blast media 24 and loosened deposits 28 collect around intake valve 30, continued application of blast media 24 causes the media to flow along air intake passageway 58 toward suction device 32 (FIGS. 3 and 11). The spent blast media and dislodged deposits thus travel upwardly through internal passageway 254 of suction device 32 into filter bag 328. When an operator is satisfied that deposits 28 have been satisfactorily removed from intake valve 30, the operator actuates toggling switch 174 to the position for selecting unaltered air. In this position, toggle switch 174 communicates control air supply from control air supply line 168 to control air return line 176 thus activating unaltered air control valve 156. Air control valve 156 shifts causing compressed air to be directly fed into main conduit 178 through gate-type check valve 160, gate-type check valve 160 preventing back flow into pressure tank 128. Unaltered air flows through main conduit 178 in delivery hoses 38 and 40 to nozzle tip 80. Unaltered air is fed into mixing chamber 68 adjacent intake valve 30 causing the remaining spent blast particles and loosened deposits to be blown away from intake valve 30 and through air intake passageway 58 into and through suction device 32 into air filter bag 328.

When the operator is finished, toggle switch 174 is released such that it returns to a normal closed position such that no air is communicated through main conduit 178. Specifically, in the normal position, unaltered air control valve 156 and blast media control valve 158 return to their normally closed position such that blasting media 24 and unaltered air are not delivered through delivery hoses 38 and 40.

It should be noted that pressure tank 128 is optimally sized such that several intake valves 30 can be sequentially blasted and cleaned. Further, the design of blasting device 22 and suction device 32 allows the mechanic or operator to move from one cylinder and intake valve to the next without constantly returning to and fussing with supply system 42. Significantly, suction device 32 is readily moved from one air intake passageway 58 to the next without significant effort. Further, both blasting device 22 and suction device 32 allow remote control adjacent the engine, so that the mechanic has adequate control immediately beside engine 26 and is not required to leave the engine area to control apparatus 20. Further, blasting device 22 and suction device 32 are operated by compressed air so as to minimize the possibility of sparks and the like.

It is specifically contemplated that, although the preferred embodiment described herein is illustrated for use in cleaning intake valves on internal combustion engines, the invention can be utilized to remove carbon from any portion of the engine combustion chamber. Furthermore, the invention is not limited to use with internal combustion engines, and can be used to remove hidden deposits from any accessible surface within any blind enclosure or housing.

Changes and modifications in the specifically described embodiment can be carried out with departing from the principles of the invention, which is intended to be limited only by the scope of the invented claims as interpreted according to the principles of patent law including the Doctrine of Equivalents.

The embodiments of the invention in which an exclusive property or privilege is claimed are defined as follows:

1. An apparatus for removing undesirable deposits on a selected part positioned within the interior of an enclosure having at least one exposed passageway defined to said interior of said enclosure, comprising:

supply means for selectively individually injecting blast media and unaltered air through one said exposed passageway and directing the selected one of said media and unaltered air against the selected part; and removal means for removing media and dislodged deposits from said part through one said exposed passageway, said removal means including a body having a port, suction means for drawing a vacuum on said port, and adjustable mounting means for providing universal substantially airtight mounting of said port over one said exposed passageway, said adjustable mounting means being adapted to engaging a range of opening sizes.

2. The apparatus as set forth in claim 1 wherein said supply means and said removal means are configured in a manner that said supply means injects blast media and unaltered air in a said exposed passageway that is different from the said exposed passageway to which said mounting means mounts said body.

3. The apparatus as set forth in claim 2 wherein said adjustable mounting means includes a universal adapter having a compressible seal for seating against a marginal surface around a said exposed passageway.

4. The apparatus as set forth in claim 3 wherein said adjustable mounting means includes spreadable grippers that engage the sides of a said exposed passageway to hold said body to said enclosure.

5. The apparatus as set forth in claim 4 wherein said suction means includes a spark proof actuator means for energizing said suction means.

6. The apparatus as set forth in claim 1 wherein said suction means utilizes compressed air to create the vacuum on said port.

7. The apparatus as set forth in claim 3 wherein said compressible seal is removable and replaceable.

8. The apparatus as set forth in claim 7 including a plurality of compressible seals adapted to fit differently sized ones of said exposed passageway.

9. The apparatus as set forth in claim 6 wherein said body includes a quick disconnect compressed air connector that allows a supply hose dispensing compressed air to said body to be freely twisted relative to said body to thereby prevent twisting and binding forces being applied to said body.

10. The apparatus as set forth in claim 9 wherein said body defines a longitudinal axis, and said body includes a pair of body portions that mutually rotate about said longitudinal axis when said body is mounted on said enclosure, and said compressed air connector is on one of said pair of body portions to allow the supply hose dispensing the compressed air to be routed in a desired direction.

11. The apparatus as set forth in claim 1 wherein said body includes a filter bag to catch the spent media and dislodged deposits as the spent media and dislodged deposits are drawn by vacuum from said enclosure.

12. The apparatus as set forth in claim 11 wherein said body includes a compressed air shutoff valve.

13. An apparatus to remove undesirable deposits on a selected internal engine part of a partially disassembled engine having a first and second exposed passageway defined to said engine part comprising:

supply means for selectively individually injecting blast media and unaltered air through said first exposed passageway and directing the selected one of said media and air against said engine part; and removal means for removing blast media and dislodged deposits from said engine part through said second exposed passageway, said removal means including a body having a port, suction means for drawing a vacuum on said port, and adjustable mounting means for providing universal mounting of said removal means to a range of opening sizes.

14. The apparatus as set forth in claim 13 wherein said adjustable mounting means includes a universal adapter having a compressible seal for seating against an exposed opening defined by the second exposed passageway.

15. The apparatus as set forth in claim 14 wherein said adjustable mounting means includes spreadable grippers that engage the sides of said first exposed passageway to hold said body to said partially disassembled engine.

16. The apparatus as set forth in claim 14 wherein said compressible seal is removable and replaceable.

17. The apparatus as set forth in claim 16 including a plurality of compressible seals adapted to fit differently sized exposed openings in the exposed passageways in engines.

18. The apparatus as set forth in claim 13 wherein said suction means includes a spark proof actuator means for energizing said suction means.

19. The apparatus as set forth in claim 18 wherein said suction means utilizes compressed air to create the vacuum on said port.

20. The apparatus as set forth in claim 13 wherein said body includes a quick disconnect compressed air connector that allows a supply hose dispensing compressed air to said body to be freely twisted relative to said body to thereby prevent twisting and binding forces being applied to said body.

21. The apparatus as set forth in claim 20 wherein said body defines a longitudinal axis, and said body include a pair of body portions that mutually rotate about said longitudinal axis when said body is mounted on said partially disassembled engine and said compressed air connector is one of said pair of body portions to allow the supply hose dispensing the compressed air to be routed in a desired direction.

22. The apparatus as set forth in claim 13 wherein said body includes a filter bag to catch the spent media and dislodged deposits as the spent media and dislodged deposits are drawn by vacuum from the partially disassembled engine.

23. The apparatus as set forth in claim 13 wherein said body includes a compressed air shutoff valve.

24. An apparatus to remove undesirable deposits on a selected internal engine part of a partially disassembled engine having an exposed passageway defined to said engine part comprising:

supply means for selectively individually supplying blast media and unaltered air, said supply means including a pressure tank adapted to dispense blast media;

delivery means for delivering the blast media and unaltered air from said supply means to the engine, said delivery means including nozzle means for directing the selected one of said blast media and unaltered air against the undesirable deposits on the selected internal engine part through the exposed passageway, and further including a main conduit for conveying the blast media and unaltered air to said nozzle means;

remote control means for causing said supply means to selectively switch between supplying the blast media and the unaltered air, said remote control means locatable adjacent the partially disassembled engine to facilitate the use thereof by an operator; and means for removing the spent blast media and dislodged deposits from the engine.

25. The apparatus as set forth in claim 24 wherein said remote control means is integral with said delivery means.

26. The apparatus as set forth in claim 25 wherein said remote control means includes a hand grip and selector switch.

27. The apparatus as set forth in claim 24 wherein said nozzle means includes an elongated rigid tubular nozzle tip, said nozzle tip including an externally mounted seal for sealingly engaging an exposed opening defined the exposed passageway in the engine.

28. The apparatus as set forth in claim 27 wherein said nozzle tip is slideably and rotatably movable within said externally mounted seal so that said nozzle tip can be moved and oriented in different positions while said seal is sealingly engaged.

29. The apparatus as set forth in claim 28 wherein said seal is shaped to sealingly engage a fuel injector mounting opening.

30. The apparatus as set forth in claim 24 wherein nozzle means includes a hose portion having a quick disconnect at one end for attaching to said nozzle tip, said quick disconnect allowing said nozzle tip to rotate relative to said hose portion.

31. The apparatus as set forth in claim 30 wherein said quick disconnect includes wall means defining an internal bore, said wall means being devoid of abrupt transitions to reduce internal wear.

32. The apparatus as set forth in claim 31 including a plurality of said nozzle tips each having differently shaped components thereon.

33. The apparatus as set forth in claim 24 wherein said remote control means is spark proof.

34. The apparatus as set forth in claim 33 wherein said remote control means includes at least one pneumatic control valve.

35. The apparatus as set forth in claim 24 wherein said remote control means includes a hand grip integrally attached to said delivery means, said hand grip including a selector switch to cause said supply means to selectively switch between supplying the blast media and the unaltered air.

36. The apparatus as set forth in claim 35 wherein said delivery means includes a multi-conduit portion, said multi-conduit portion including said main conduit for conveying the blast media and unaltered air to the nozzle means, and further including at least one control supply line for conveying control air to said supply means, said at least one control supply line allowing said remote control means to pneumatically communicate with said supply means to cause said supply means to selectively switch between the blast media and the unaltered air.

37. The apparatus as set forth in claim 24 wherein said supply means includes a pressure tank adapted to mix blast particles with pressurized air to create the blast media, said pressure tank having an air inlet and outlet adapted to create a swirling pattern of air flow which causes the blast particles to be gradually picked up and dispensed thereby promoting more uniform dispensing of the blast particles in the blast media.

38. The apparatus as set forth in claim 37 wherein said pressure tank is defined by a wall having a cylindrical wall portion and wherein said cylindrical wall portion and said air inlet and outlet include openings defining flow passages tangential of said cylindrical wall portion.

39. The apparatus as set forth in claim 38 wherein said pressure tank includes a blast particle load inlet that is adapted to prevent overfill of the blast particles in said pressure tank.

40. The apparatus as set forth in claim 39 wherein said blast particle load inlet includes a blast particle inlet shutoff valve to prevent backflow through said load inlet when said pressure tank is pressurized.

41. The apparatus as set forth in claim 40 wherein said blast particle inlet shutoff valve includes a remote manual shutoff handle extending therefrom, and said apparatus further includes a safety valve pneumatically serially connected to said air inlet and operably connected to said remote manual shutoff handle so that said pressure tank cannot be pressurized when said remote manual shutoff handle and said blast particle shutoff valve are in the position allowing blast particles to be added to said pressure tank.

42. A system to remove undesirable deposits on a selected internal engine part of a partially disassembled engine having a first and second exposed passageway defined to said engine part comprising:

supply means for selectively individually supplying blast media and unaltered air;

delivery means for delivering the blast media and unaltered air from said supply means to the selected internal engine part, said delivery means including nozzle means for directing the selected one of said blast media and unaltered air against the undesirable deposits on the selected internal engine part through said first exposed passageway;

remote control means for causing said supply means to selectively switch between supplying the blast media and supplying the unaltered air, said remote control means locatable adjacent the nozzle means to facilitate the use thereof by an operator; and removal means for removing media and dislodged deposits from said engine part through said second exposed passageway, said removal means including a body having a port, suction means for drawing a vacuum on said port, and adjustable mounting means for providing universal mounting of said removal means to a range of opening sizes.

43. The system as set forth in claim 42 wherein the first and second exposed passageways include portions that are separately distinct from each other.

44. A pressure tank for holding and mixing particles with pressurized air to create a media useful to remove undesirable deposits on a selected internal engine part of a partially disassembled engine comprising:

a pressure tank defined by a wall having a cylindrical wall portion, air inlet and outlet ports; said air inlet and outlet ports being tangentially connected to said cylindrical wall portion and adapted to create a swirling pattern of air flow which causes particles located in said pressure tank to be gradually picked up and dispensed thereby promoting more uniform distribution of particles in the air, said wall further including an upper wall portion having a particle load inlet port, said particle load inlet port including a shutoff means for closing said particle load inlet port when said pressure tank is pressurized.

45. The apparatus as set forth in claim 44 wherein said shutoff means includes a ball shutoff valve.

46. The apparatus as set forth in claim 45 wherein said air inlet and outlet ports are located adjacent said upper wall portion.

47. The apparatus as set forth in claim 46 wherein said particle load inlet port includes a nipple that extends into the interior of said pressure tank and prevents said pressure tank from being overfilled with particles.

48. The apparatus as set froth in claim 47 wherein said nipple is vertically adjustable.

49. The apparatus as set forth in claim 44 including a means for preventing said pressure tank from being pressurized when said shutoff means on said particle load inlet port is in a position permitting backflow of air through said particle load inlet port.

* * * * *